US005231236A

United States Patent [19]

Del Real et al.

[11] Patent Number: 5,231,236

[45] Date of Patent: Jul. 27, 1993

[54] SAFETY LOCK FOR FIREARMS

[76] Inventors: Carlos Del Real, 7305 Damascus Rd., Gaithersburg, Md. 20882; Greg Del Real, 3304 Old Largo Rd., Upper Marlboro, Md. 20772

[21] Appl. No.: 817,494

[22] Filed: Jan. 7, 1992

[51] Int. Cl.[5] ..... F41A 17/02

[52] U.S. Cl. ..... 42/70.11

[58] Field of Search ..... 42/70.11, 70.01

[56] References Cited

U.S. PATENT DOCUMENTS

| | | | |
|---|---|---|---|
| 2,327,334 | 8/1943 | Parker | 42/70.11 |
| 2,505,227 | 4/1950 | Charters | 42/70.07 |
| 2,512,140 | 6/1950 | Childs et al. | 42/70.07 |
| 2,599,132 | 6/1952 | Sass | 42/70.07 |
| 2,742,726 | 4/1956 | Feller | 42/70.07 |
| 2,997,802 | 8/1961 | Robbins | 42/70.11 |
| 3,018,576 | 1/1962 | Riechers | 42/70.11 |
| 3,089,272 | 5/1963 | McKinlay | 42/70.11 |
| 3,378,943 | 4/1968 | Valburg | 42/70.11 |
| 3,392,471 | 7/1968 | Foote | 42/70.07 |
| 3,605,311 | 9/1971 | Hermann | 42/70.11 |
| 3,624,945 | 12/1971 | Foote | 42/70.07 |
| 3,634,963 | 1/1972 | Hermann | 42/70.11 |
| 4,266,356 | 5/1981 | Jarvinen | 42/70.11 |
| 4,619,062 | 10/1986 | Johnson | 42/70.11 |
| 4,654,992 | 4/1987 | Lavergne | 42/70.11 |
| 4,761,906 | 8/1988 | Guevara | 42/70.11 |

FOREIGN PATENT DOCUMENTS

| | | | |
|---|---|---|---|
| 2920679 | 11/1979 | Fed. Rep. of Germany | 42/70.11 |
| PCTAU89/0-0409 | 4/1990 | PCT Int'l Appl. | 42/70.11 |

*Primary Examiner*—Charles T. Jordan

*Attorney, Agent, or Firm*—Penrose L. Albright

[57] ABSTRACT

A safety locking device for firearms disposed intermediate their firing pins and barrels which comprises a T-shaped casing with generally cylindrical, vertical and horizontal parts and having a diameter which is adapted to be received in firearms for which it is intended and containing a pair of locking deadbolts slidably extensible therefrom by means of a locking device in the vertical portion of the housing so that they can be effectively locked in place between the firing pin and the barrel of the firearm for which it is intended and cannot be removed, thus rendering the firearm inoperative as long as they are so positioned. The deadbolts are extendible in opposite directions by 180° movement actuated by the locking device and a cam carrier which is turned by the locking device and carries a pair of cam actuating pins to move the deadbolts in and outwardly from the horizontal part of the T-shaped housing. The deadbolts are maintained in their desired positions along their common longitudinal axis by the housings, and by cam pins received in apertures and cam guidance channels in one arrangement, and by cam pins in cam channels together with vertical sides of deadbolt extensions in juxtaposition sliding against each other in another arrangement.

22 Claims, 3 Drawing Sheets

SAFETY LOCK FOR FIREARMS

FIELD OF THE INVENTION

This invention relates to a safety lock for firearms having openings for the ejection of cartridge casings, particularly semi-automatic pistols, but also for revolvers, the safety lock being, in part, insertable into the ejection port of the firearm, capable of being locked in a manner wherein it cannot be removed and, at the same time, providing a positive barrier between the firearms' firing pin and its chamber wherein cartridges are received when the firearm is otherwise operational.

BACKGROUND OF THE INVENTION

A recognized problem with firearms is that they can be accidentally discharged to cause serious injury or death to persons nearby. For this reason, it is customary for owners of firearms to lock same in special cabinets or other containers whereupon they are only taken out for use. However, firearms are often stored in places which either cannot be locked, or it would be inconvenient to do so. For safety purposes, guns should not be stored with cartridges in their chambers, or even in their magazines, and almost all firearms incorporate safety features. Still, there are a number of accidental injuries and deaths that occur on a continuing basis due to "unloaded" guns.

A common type of apparatus used for preventing firearms' accidental discharges are trigger locks. Unfortunately, trigger locks do not always prevent the trigger from being pulled (or pushed) and, in any event, a firing pin can often be tripped irrespective of the presence of a trigger lock on a semi-automatic firearm. Further, trigger locks are awkward and difficult to install. Thus, whereas trigger locks may be worthwhile safety equipment for some firearms, they are not a complete answer, because accidental discharge of firearms in spite of their installation thereon is frequently possible.

A further solution that has been proposed constitutes plug-in types of locking devices. For example, PCT Patent Publication No. W090/04148, of Apr. 19, 1990, of Paterson, discloses a lock for a revolver which is inserted into one of the chambers of the cylinder when the cylinder is in an open position, and is then expanded and locked in the expanded condition to prevent its withdrawal from the cylinder. As long as the cylinder cannot therefore be closed, the revolver cannot be discharged. Another firearm safety device is disclosed in the Federal Republic of Germany's Offenlegungsschrift No. 2920679, of Troedsson, published Nov. 29, 1979, which discloses a plug-in safety lock for cartridge case openings of firearms. Disclosed is a body which can be inserted into the ejection port of a firearm and which is provided at least one piston telescopically received within the body which can be extended therefrom into the cartridge chamber. In this manner, the plug-in safety lock cannot be removed through the ejection port, and the firing pin is effectively prevented from moving more than a limited amount towards the chamber. This is accomplished either by a rack and pinion arrangement, which can be locked in two settings, or by use of an eccentric pin which cooperates with a biased cam groove to move a plug on one side outwardly for locking the device in place and inwardly for being removed from the firearm involved. However, the Troedsson plug-in safety lock is designed apparently primarily for rifles, and its extendibility, when inserted within the ejection port, is limited which, in turn, limits its usefulness for handguns, wherein the amount of expandability may spell the difference between an effective lock and a lock which may be removed with the exertion of only moderate force.

U.S. Pat. No. 3,089,272, to McKenlay, of May 14, 1963, is directed to a locking type safety breech plug for firearms. The breech plug comprises a fixed rear nose and a forward sliding plunger which is actuated by the user's finger after insertion of the breech plug into the ejection port of the firearm. A key is actuated to lock the plunger in its extended position. It is to be understood that the key does not actuate the plunger and therefore two operations are required, the locking operation being effected after actuating the plunger into its desired position in the firearm. Effectively this requires two hands, one exerting a rearward force to maintain the nose against the rear inner wall of the ejection port, and the other exerting a forward force to slide the plunger manually into the forward portion of the ejector port. The installation is therefore awkward and also difficult in view of the need to hold the firearm at the same time.

A locking safety device for firearms is also disclosed in U.S. Pat. No. 3,018,576, to Riechers, of Jan. 30, 1962. The device is box-shaped and relatively large, whereby it is not readily portable by the owner or user of the firearm. The installation of the device is such that most of the device is situated outside the receiver of the firearm so that it is more susceptible to tampering than otherwise would be the case. The Riechers' device comprises a single sliding component having a limited distance of travel whereby, in effect, the device will not generally be useful for more than one or a few models of firearms. This is particularly true because its exterior contour matches that of the firearm and, accordingly, the device almost of necessity has to be of a different configuration for different models of firearms.

U.S. Pat. No. 4,266,356, to Jarvinen, of May 12, 1981, discloses a non-movable chamber plug in combination with a locking mechanism that fits into a recess of a receiver, such as a bolt lug recess. Here, as with Riechers' device discussed above, due to variations in the configurations of different models of firearms, including in particular the receivers, it is difficult to conclude that this device will fit more than one model of specific firearms.

Another U.S. Patent of interest is No. 3,634,963, to Hermann, of Jan. 18, 1972, which discloses a locking device that is placed into the ejection port of a firearm. The device is locked by a key and includes an extensible member on one side that, in cooperation with a permanent biased member on the other side, holds the lock in place. The same inventor, Hermann, discloses in another U.S. Pat. No. 3,605,311, of Sep. 20, 1971, a removable firearm lock which is insertable in a firearm ejection port having a latch operated by a key on one side of the lock.

A trigger lock is disclosed in U.S. Pat. No. 3,624,945, of Dec. 7, 1971, which not only blocks access to the trigger, but also severely restricts any motion by the trigger while the lock is installed on a revolver.

SUMMARY OF THE INVENTION

The instant invention is directed to a positive firearm safety locking device connected via a T-shaped housing to a pair of extensible deadbolts for receipt through a handgun's ejection port into its chamber, wherein the deadbolts can be telescopically extended outwardly in opposite directions to increase the distance between the outer ends of the deadbolts by up to about 50% or more (for example 70% in one embodiment) relative to the distance between them of when they are inserted in the ejection port. This is accomplished in one of the embodiments by telescoping one of the deadbolts within the other, and providing actuating cam pins which are aligned with the longitudinal axis of the deadbolts both in the retracted and the extended positions, further providing, at the same time, control by means of alignment grooves to ensure that the position of the two deadbolts relative to their common longitudinal axis is controlled to remain the same throughout in an effective and affirmative manner. In another embodiment, instead of providing that the deadbolts are such that one telescopes within the other, extensions are provided which have juxtaposed sliding surfaces for maintaining, together with the housing, the relative positions of the deadbolts both when extended and retracted. It is an important advantage of the invention that housings carry the deadbolts in a snug but slidable arrangement. The T-configuration of the lock housing and the approximate 180° movement of the actuating cam pins or members in the cam guidance channels make the apparatus adaptable for a disc or pin tumbler cylinder-type lock so that it can be locked in a positive manner both in the extended and retracted positions as well as in selected intermediate positions.

The invention is also adaptable to be used not only with semi-automatic handguns having ejection ports, but also with, revolvers inasmuch as it can be inserted readily between the recoil plate on one end, and received in the forcing cone of the revolver's barrel on the other end with the cylinder pivoted from its operative position. In addition, the same locking device in accordance with the invention can be used with a number of different caliber handguns, although it is preferable that the deadbolts be sized in accordance to the handgun wherein they are installed. An advantage of the invention is that, particularly with the telescoping type of deadbolts, one of the deadbolts can be for one caliber, say, a 9-millimeter, whereas the other bolt can be for another caliber, say, a 32-caliber handgun, whereby one of the bolts may be received slidably in the chamber for its corresponding caliber.

The invention is preferably composed primarily of a metal such as a high strength steel or stainless steel, although other metals can be used. In addition, the invention may be constructed in part or whole from one or more of several known strong engineering plastic materials, and, from a manufacturing standpoint, such materials present certain definite advantages. The apparatus is relatively small in size, and is normally retained, when the safety lock is deliberately removed from the handgun, attached to the user's key chain. In any event, the safety lock in accordance with the invention is readily portable and can be carried easily in one's pocket or a pocketbook when not installed in the firearm. Incidentally, in this respect the safety lock's key, in accordance with the invention, is readily insertable in the firearm for rapid removal of the safety lock with one possessing the correct key in the event that the firearm is needed for use. Thus, with a firearm which is normally kept in a night table, by having the key on a key chain or ring, or otherwise hidden or secured so that it would not be found by one not authorized to use it, the person who knows the whereabouts of the key can remove the safety device in a manner of seconds if use of the gun may be required.

The invention also prevents unauthorized disassembly of the firearm. It is relatively inexpensive compared to other firearm safety devices and, properly constructed, will not damage the firearm's mechanism or finish.

It will be appreciated that the safety lock, in accordance with the invention, can also be used for automatic, as well as semi-automatic, and other repeating types of firearms, and that the deadbolts of the invention are so configured that one of them will displace any round of ammunition that might be found in the firearm chamber.

An important aspect of the invention is that it can be used by one hand with the key already inserted, while the other hand is used to hold the firearm.

The invention is adaptable to be used in less conventional firing chambers, due in part to the provision for its bi-directional positive retention in the firing chambers. Its adaptability to different types of firearms is increased, inasmuch as the deadbolts can be extended in designated increments. Whereas the key can be removed at the designated increments, it is preferably retained in place when the device is removed from the firearm.

Although for safety reasons it is preferable that the firearm's magazine either be unloaded or stored separately from a firearm, in cases where the firearm may be required for relatively immediate use, the invention permits the firearm to be stored with a loaded magazine in place, whereby the firearm is still effectively prevented from firing while the invention is received and locked in the firearm's ejection port, and while, at the same time, the loaded magazine is in place in the event that the firearm is required for rapid authorized deployment in emergency situations.

An important aspect of the instant invention is that it is not heavy, bulky, and difficult to use as compared, for example, with trigger-type locks presently on the market. At the same time, the instant invention is adaptable to fit many different models of firearms compared to prior art devices which are designed frequently to fit one or only a very few models of firearms.

At the present time, semi-automatic pistols are becoming more popular as compared to revolvers. Unfortunately, semi-automatic pistols tend to be more accident-prone because a round of ammunition may be inadvertently retained in the firing chamber after the firearm otherwise has been unloaded by removing the ammunition magazine. The adoption, in particular, of semi-automatic pistols by many police departments has encouraged emulation by the general public, and this, in turn, has introduced a more accident-prone firearm into many homes. Accordingly, the instant invention performs a valuable safety purpose because of its special adaptability and ease of use with semi-automatic pistols. Moreover, inasmuch as the instant invention can be produced and sold at a reasonable price, which is only a small fraction of the cost of a new firearm, its introduction and use in many households wherein firearms are kept provides an important safety product to save lives and serious injury, especially injuries to children.

Other objects, adaptabilities, and capabilities of the invention will be appreciated by those skilled in the art as the description progresses, reference being had to the accompanying drawings in which:

DESCRIPTION OF THE PREFERRED EMBODIMENTS

Figure 1:
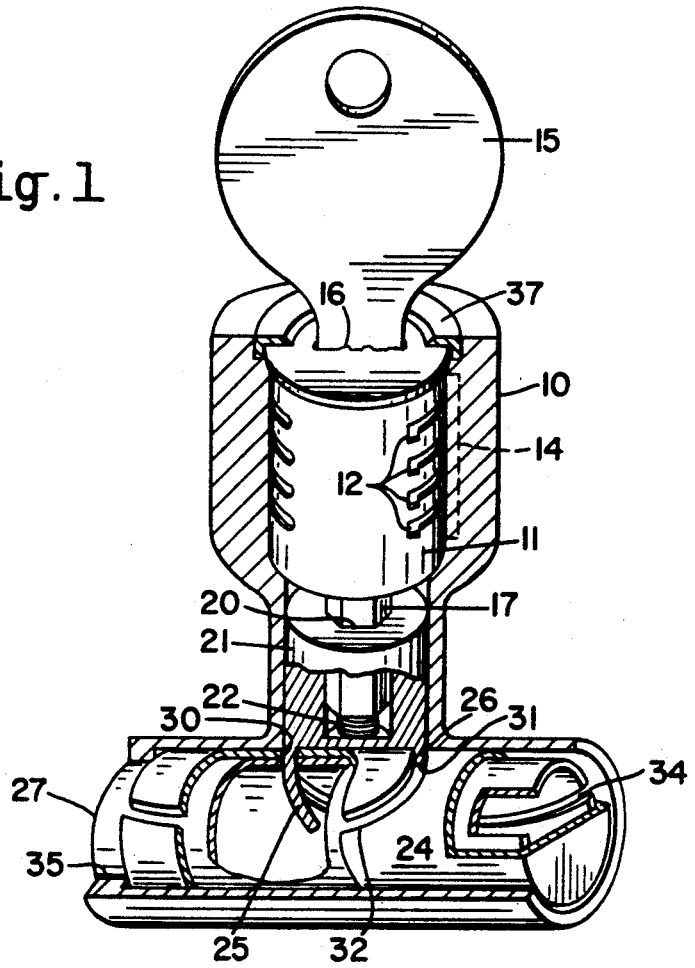
FIG. 1 is a broken away perspective illustration of the invention using a cylinder type lock and telescoping deadbolts, wherein the deadbolts are in their retracted position.

Referring, in particular, to FIG. 1, a housing 10 has mounted therein a pin or disc tumbler cylindrical type lock 11. A cap 37 that is welded or otherwise affixed to housing 10 prevents axial movement of lock 11 within housing 10. A key 15 is removably received in a key hole 16. Lock 11 includes a plurality of spring actuated disc tumblers 12 that cooperates with recesses 14 in 10 to define the opened and closed position of the device. A spindle 17, which is turnable approximately 180° by key 15 when inserted in key hole 16, extends from the bottom of cylindrical lock 11. Spindle 17 is polygonal, actually hexagonal, in cross-section and is received in a similar shaped opening 20 in a cam pin carrier 21, which is therefore adapted to turn with spindle 17 and key 15. A resilient member comprising a compression spring 22 urges cam pin carrier 21 against an outer deadbolt 24, which is snugly, but slidably received in the lower cylindrical part of housing 10. Extending downwardly from cam pin carrier 21 are a pair of cam actuator pins 25 and 26, which are curved inwardly towards each other, and which, as seen in plan from above in FIGS. 1 and 2, approximately coincide with the longitudinal axis of deadbolt 24, and also that of the interior deadbolt 27, which is snugly, but slidably received within the outer deadbolt 24.

The outer deadbolt 24 has an aperture 30 that receives pin 25, and deadbolt 27 has a further aperture 31 that receives pin 26, and an arcuate groove 32 is provided in the deadbolt 24 along which pin 26, in a relative sense, moves and is guided when pin 26 is moved approximately 180° by turning key 15. A notch 32*a* (FIG. 2) is provided on groove 32 to permit assembly of the device and otherwise is not involved in its operation. A similar notch (not shown) for the same purpose is provided for groove 34. Deadbolt 27 has a further arcuate groove 34 in which pin 25 is received when key 15 turns the cam pin carrier 21 through approximately 180°. Thus, both deadbolts 24 and 27 are moved and maintained in the desired position during such movement by pins 25 and 26 bearing in apertures 30 and 31 and grooves 32 and 34. Upon turning key 15 through approximately 180°, deadbolts 24 and 27, as well as the pins 25 and 26, and their apertures 30 and 31, are also turned approximately 180°. As used herein, "approximately 180°" refers to the rotation that can be provided by pins 25 and 26 which, in turn, may be restricted by the type of lock used and other limiting considerations. Accordingly, with certain structures "approximately 180°" will, in fact, be less, say 160°, or even about 140°. But in the embodiment shown in FIGS. 1 and 2, using an appropriate lock, the degrees that pins 25 and 26 can be turned is very close to, if not exactly, 180°. Also, because the diameter of the vertical part of the T-shaped housing 10 may be greater than that of its horizontal part, due to the inward curvature of pins 25 and 26, the length that bolts 24 and 27 may be extended can be correspondingly increased. It will be noted from FIGS. 1 and 2, incidentally, that on the left side, as seen in such figures, the housing 10 includes an inwardly extending flange 35 which bears against and slidably receives deadbolt 27. Key 15 is preferably one that can be properly inserted in two positions which are 180° displaced from each end.

Figure 2:
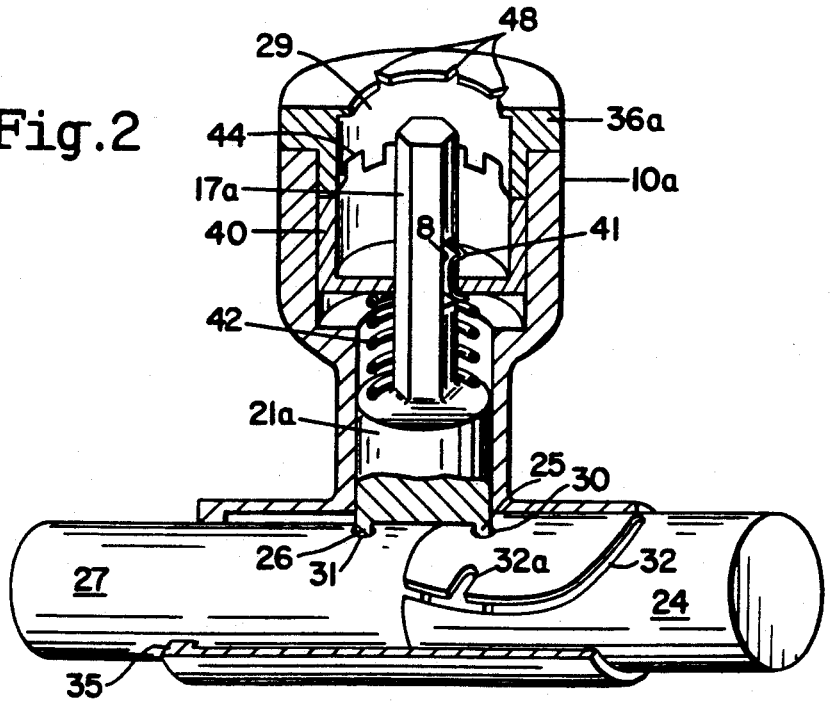
FIG. 2 is a figure similar to FIG. 1 having the same construction of deadbolts as shown in FIG. 1 with, however, a different type of locking member, the deadbolts being shown in their extended positions.

In the embodiment of FIG. 2, a specially constructed key 15*a* is employed and the internal features of lock housing 10*a* are modified to accommodate a different locking mechanism. Cam pin carrier 21*a* is, in this embodiment, integral with the hexagonal spindle or extension 17*a*. Extension 17*a* has on its side a rectangular recess 8 which retains a securing latch spring 41. Extension 17*a* is received slidably through the hexagonal aperture in the base of the lock ring 40 which, in turn, is secured in its raised (locked) position by a lower outwardly extending part of latch spring 41 which engages the bottom of lock ring 40. An important feature of lock ring 40 is the provision of castleations 44 around its upper rim which coincide with inverse recesses provided around the lower rim of a cap 36*a* that is welded or otherwise affixed to housing 10*a*. A compression spring 42 bears vertically between the cam pin carrier 21*a* and lock ring 40, thereby urging lock ring 40 into engagement with cap 36*a*, whereby the castleations 44 prevent relative rotation between cap 36*a* and lock ring 40, and hence retraction of deadbolts 24 and 27.

To unlock the device shown in FIG. 2, a key 15*a*, which has a generally cylindrical shaft 18 having a projection 19 that has a triangular cross-section and a relatively deep hexagonal recess 28 of a configuration which corresponds with and is received over extension 17*a*. Key 15*a* is inserted through the opening 29 in cap 37*a* and is aligned by the triangular projection 19 received in any notch 48. Upon the lower edge of key 15*a* engaging the lock ring 40 and being pressed downwardly relative thereto, lock ring 40 is disengaged from its connection to cap 36*a*, the key 15*a* moving the securing latch spring 41 inwardly by its engagement of the upper slanted part of spring 41, thereby causing its lower part to retract into recess 8, thus allowing lock ring 40 to move downwardly and compress spring 42. Castleations 44 are therefore drawn free of the corresponding recesses in cap 36*a* which allows lock ring 40 to be rotated together with extension 17*a* and cam pin carrier 21*a* so that pins 25 and 26, received in apertures 30 and 31, are turned, thereby retracting deadbolts 24 and 27 by an 180° counterclockwise rotation via key 15*a*, extension 17*a* and cam pin carrier 21*a*. In operation, key 15*a* is, when deadbolts 24 and 27 are completely retracted, retained in the device by the triangular projection 19, which permits the unit to be carried on a key ring because key 15*a* is then disposed so that projection 19 is not aligned with one of the notches 48. Although only three notches 48 are shown in FIG. 2, in fact, five separate notches 48 are placed around the edge of the opening 29 of cap 37*a*. The first three notches 48 as shown indicate lockable positions for the device wherein the key 15*a* may be released at different degrees of its potential rotation, thus permitting different lengths of extensions of deadbolts 24 and 27. It should also be noted that any one of these five notches 48 may be selected to be aligned with the triangular projection 19 of key 15*a* to retract bolts 24 and 27 and remove the device quickly from the firearm in which it is installed.

Figure 3:
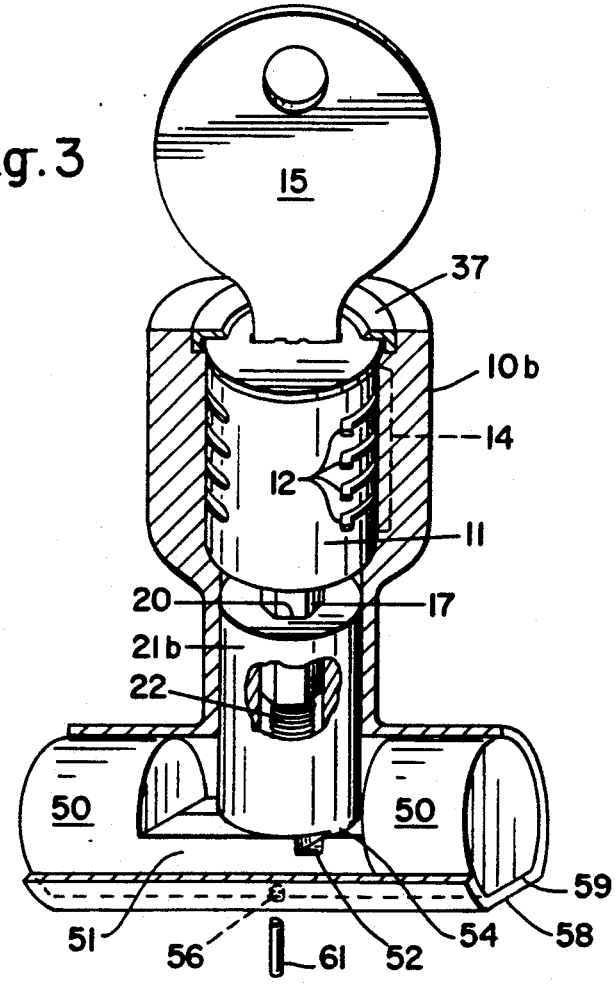
FIG. 3 discloses a further embodiment in a perspective view with parts broken away to show the interior of the device, wherein cam actuated deadbolts have a juxtaposed mutually slidable extensions.
Figure 4:
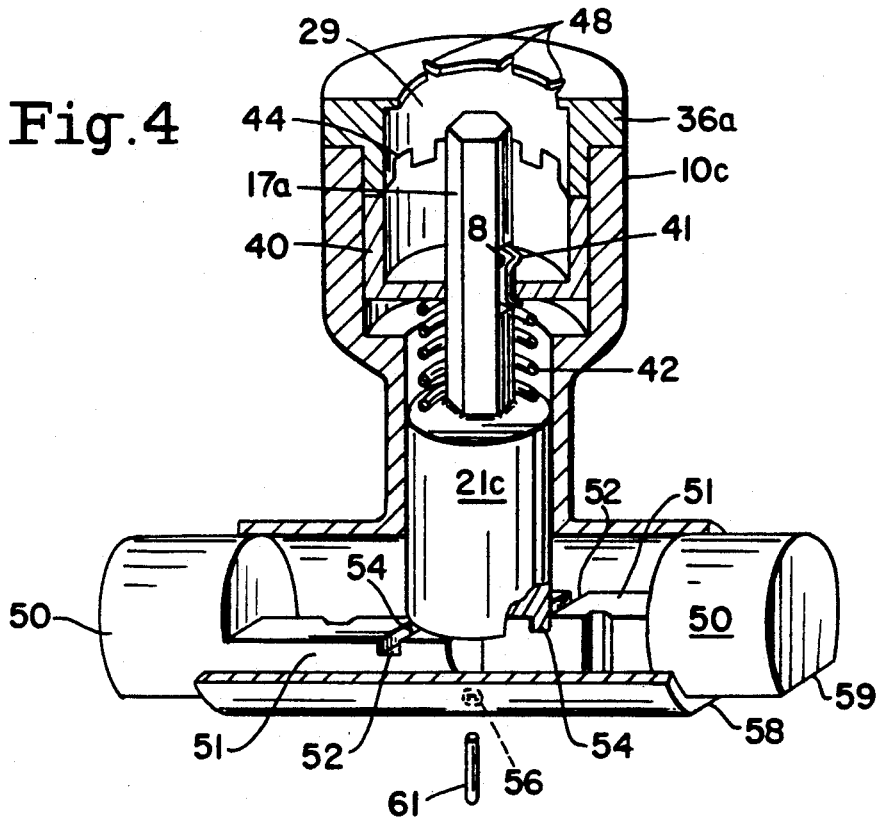
FIG. 4 is an embodiment similar to FIG. 3, except that the locking device is the same as shown in FIG. 2, and the deadbolts, which are the same as shown in FIG. 3, are in extended positions.
Figure 5A:
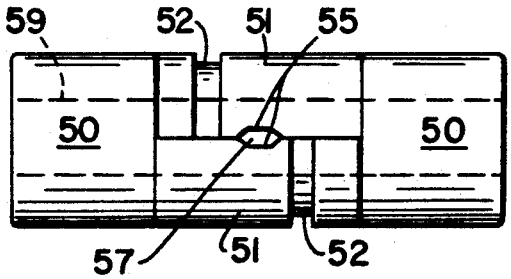
FIGS. 5A and 5B are plan views of the deadbolts shown in FIGS. 3 and 4 in retracted and extended positions respectively.
Figure 5B:
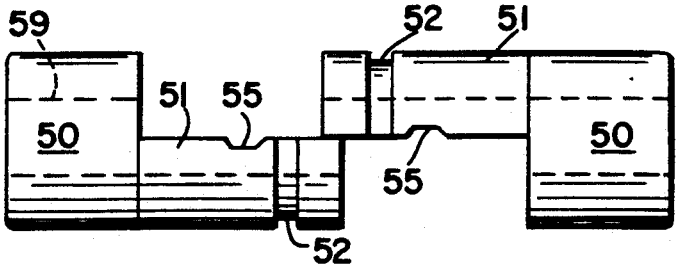

In FIGS. 3 and 4, the upper portions comprising the pin or disc tumbler cylinder-type lock 11, tumbler 12, recesses 14, key 15, key hole 16, spindles 17 and 17*a*, compression spring 22, caps 37 and 36*a*, and spindle opening 20, are substantially the same as in the respective FIGS. 1 and 2 where they are used. A functionally similar cam pin carrier 21*b* is also provided. The housings 10*b* and 10*c* are essentially identical to housings 10 and 10*a* in FIGS. 1 and 2, except for the absence of the inwardly extending flanges 35 and the provision of opening 56 and bottom flat area 58. The deadbolts 50 in FIGS. 3 and 4 each have a right lower quarter extension 51 which contains a cam guidance channel 52 that, in the embodiments shown, is perpendicular to a common longitudinal axis of the deadbolts 50. Channel 52 can, however, be slanted or otherwise configured in a manner which would occur to one skilled in the art. In FIG. 3, the deadbolts 50 are shown in their retracted or withdrawn in positions, whereas in FIG. 4, deadbolts 50 are extended due to cam pin carrier 21 having been revolved about 180° in FIG. 4 relative to that shown in FIG. 3. The extensions 51 have flat inward vertical surfaces which slide in juxtaposition against each other, whereby the deadbolts, when extended, are retained in their desired positions not only by their housings 10*b* and 10*c*, but also by the cam pin carriers 21*b* and 21*c* and cam pin member 54 bearing on the channels 52, being so urged by the relatively strong compression spring 22, and the interior vertical sides of extensions 51 bearing slidably against each other. This relative movement is illustrated in FIGS. 5A and 5B, wherein the deadbolts 50 are shown in their retracted positions in FIG. 5A and in their extended positions in FIG. 5B due to a rotation of the actuated cam pin members 54. Deadbolts 50 also are provided in a lower flat area 59 to cooperate with flat area 58 of housing 10*b*.

Deadbolts 50 may be provided in their juxtaposed sides with slots 55 which, when the deadbolts 50 are closed, as shown in FIG. 5A, permit insertion of a tool 61 through a corresponding opening 56 centered in bottom of housings 10*b* and 10*c* which is aligned with a further opening 57 defined by slots 55 to lift the cam pin carrier 21*b* or 21*c* together with cam pin members 54, whereby deadbolts 50 can be removed from housings 10*b* and 10*c* and replaced with longer or shorter deadbolts or deadbolts which may be provided that have different diameter heads and dimensions to fit different gun calibers.

Figure 2A:
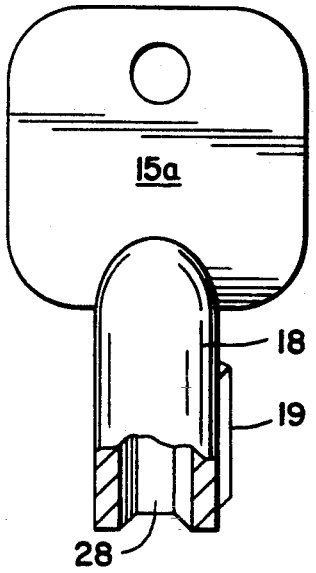
FIG. 2A shows a key that is partly broken away to reveal its interior structure which is used with the locking members of FIGS. 2 and 4.

In FIG. 4, the upper part of the device is essentially identical and operates the same as disclosed with reference to FIG. 2, using the key shown in FIG. 2A, whereas the lower part which shows deadbolts 50 to be extended is otherwise the same as shown in FIG. 3. Cam pin carrier 21*c* is integral with extension 17*a* as in cam pin carrier 21*a* in FIG. 2. Cam pin members 54 in FIG. 4 are functionally the same as those in FIG. 3.

It will be accordingly appreciated from the disclosure that in all embodiments, the deadbolts are guided by at least three elements. In FIGS. 1 and 2, these comprise the housings 10 and 10*a*, the pins 25 and 26 received in apertures 30 and 31, and also by the cam alignment grooves 32 and 34. In addition, the telescoping structure of deadbolts 24 and 27 provide mutual support. In FIGS. 3 and 4, again the alignment is provided by the housings 10*b* and 10*c*, the cam pin members 54 received in the guidance channels 52, and by the vertical side surfaces of the quarter extensions 51 where they bear against each other. In addition, the deadbolts 50, which are received snugly, but slidably within the lower part of housings 10*b* and 10*c*, include at their bottoms flat areas 59, which correspond to flat areas 58 of housings 10*b* and 10*c*. This arrangement prevents relative rotation between housings 10*b* and 10*c* on one hand, and deadbolts 50 on the other, while contributing to the structured restraint and positive guidance of deadbolts 50 within housings 10*b* and 10*c*.

The foregoing detailed description of the various embodiments of the invention has been provided for a clearness of understanding only and no unnecessary limitations should be understood therefrom for various modifications will be obvious to those skilled in the art in the light of the above disclosure.

Having disclosed our invention, what we claim as new and to be secured by letters Patent of the United States is:

1. A safety device for firearms having an ejection port and a chamber; said device comprises:

a housing having a configuration so that it can be received in the ejection port of the firearm for which it is designed;

a pair of locking deadbolts slidably received at each end of said housing which are extensible relative thereto and at least one of which is adapted to be received in the chamber of the firearm for which the locking device is designed;

a locking member firmly attached to and extending abnormally from said housing so that it will project out of said ejection port when said housing including said deadbolts are received therein;

a cam pin carrier including cam pin members operatively connected to said deadbolts and said locking member in a positive engagement so that when said locking member moves said cam pin carrier in a first direction, said deadbolts are moved outwardly relative to said housing so that at least one of said deadbolts is received in said chamber and is locked therein, and when said locking member moves said cam pin carrier in a second direction, said deadbolts are retracted into said housing, sand said one deadbolt is retracted from said chamber so that the device can be removed from the ejection port of the firearm involved, said deadbolts being in slidable engagement with each other, whereby when being extended and retracted they move in a slidable engagement with each other to prevent the undesirable biasing of said deadbolts during such movement and so when in their extended and retracted positions they retain the same common longitudinal axis.

2. A safety device in accordance with claim 1 wherein said cam pin carrier is rotatable by said locking member approximately 180°, and said deadbolts are each movable by turning said locking member by a longitudinal distance that is at least about equal to the diameter of said cam pin carrier.

3. A safety locking device in accordance with claim 1, wherein said cam pin carrier has on opposite sides thereof said cam pin members which internally engage openings in corresponding said deadbolts.

4. A safety locking device in accordance with claim 3, wherein said deadbolts comprise a first deadbolt and second deadbolt, the first said deadbolt being telescopically received in said second said deadbolt, each said deadbolt comprising an aperture for receiving a corresponding cam pin member and further comprises a cam alignment groove for receiving said cam pin member for the other said deadbolt, said cam alignment grooves also serving to limit rotation of the cam pin carrier.

5. A safety locking device in accordance with claim 3, wherein said deadbolts each comprise an inwardly extending portion, said portions adapted to slide against each other and said deadbolts also each including a cam guidance channel that receives a corresponding said cam pin member.

6. A safety locking device in accordance with claim 1, wherein said locking member comprises a key, and means being provided to retain said key in said locking member when said deadbolts are in their fully retracted positions.

7. A safety lock in accordance with claim 1, comprising a plurality of discreet different extended positions to which said deadbolts can be extended, and means for retaining said deadbolts selectively in each of said extended positions.

8. A safety device in accordance with claim 1, wherein said deadbolts are telescopically connected and which are rotated in opposite directions by said cam pin carrier when they are being extended.

9. A safety device in accordance with claim 1, including means for removing said deadbolts, and at least one further deadbolt of a different size than a deadbolt which has been removed from said device, said one further deadbolt being selectively installed in the place of said deadbolt which was removed.

10. A safety device for firearms having a recoil plate, cylinder, and forcing cone; said device comprises:

a housing having a configuration so it can be received in the ejection port of the firearm for which it is designed;

a pair of locking deadbolts slidably received in each end of said housing which are extensible relative thereto, and at least one of which is adapted to be received in the chamber of the firearm for which the locking device is designed;

a locking member firmly attached to and extending normally from said housing so that it will project out of said ejection port when said housing, including said deadbolts, are received therein, said locking member comprising a plurality of resiliently biased disc tumblers; and a key member included in said locking member, a plurality of recesses in said housing cooperating with said tumblers to release said key member from said locking member so that it can be removed therefrom when said locking member is received in said ejection port, said tumblers when not in said plurality of recesses functioning to retain said key member in said locking member at all times except when said locking deadbolts are in extended positions relative to said housing.

11. A safety device in accordance with claim 10, wherein said key comprises a key which is reversible, whereby it can be inserted in said locking member in two positions which are displaced from each other by 180°.

12. A safety device for firearms, having an ejection port and a chamber; said device comprises:

a housing having a configuration so that it can be received in the ejection port of firearms for which it is designed;

a pair of locking deadbolts slidably received at each end of said housing which are extensible relative thereto;

a locking member firmly attached to and extending normally from said housing so that it will project out of said ejection port when said housing, including said deadbolts, are received therein;

cam means operatively interconnected to said deadbolts, and said locking members in a positive engagement so that when said locking member moves said cam means in a first direction, said deadbolts are moved outwardly relative to said housing, so that at least one of said deadbolts is receivable in said chamber, and when said locking member is moved by said cam means in a second opposite direction, said deadbolts are retracted into said housing, whereby the device can be removed from the ejection port of a firearm for which it is designed;

deadbolt removal means included in the safety device for removing said deadbolts when said deadbolts are retracted; and a plurality of replacement deadbolts which are adapted for a plurality of different caliber firearms, said further replacement deadbolts replacing the deadbolts originally in said housing which have been removed therefrom by said deadbolt removal means so that their sizes correspond with the caliber of the specific firearm for which the locking device is intended to be used.

13. A safety device in accordance with claim 12, wherein said deadbolt removal means comprises a tool which is insertable through said deadbolts only when they are in their retracted position in said housing to lift said cam means, from its operative connection to said deadbolts, said further replacement deadbolts being placed in said housing in their retracted positions, while said tool retains said cam means from engaging said further replacement deadbolts.

14. A safety device for firearms having an ejection port and a chamber; said device comprises:

a housing having a configuration so that it can be received in the ejection port of the firearm for which it is designed;

a pair of locking deadbolts slidably received at each end of said housing which are extensible relative thereto and at least one of which is adapted to be received in the chamber of the firearm for which the locking device is designed;

a locking member firmly attached to and extending normally from said housing so that it will project out of said section port when said housing including said deadbolts are received therein;

a cam pin carrier including cam pin members operatively connected to said deadbolts and said locking member in a positive engagement so that when said locking member moves said cam pin carrier in a first direction, said deadbolts are moved outwardly relative to said housing so that at least one of said deadbolts is received in said chamber and is locked therein, and when said locking member moves said cam pin carrier in a second direction, said deadbolts are retracted into said housing, and said one deadbolt is retracted from said chamber so that the device can be removed from the ejection port of the firearm involved, said deadbolts being in slidable engagement with each other, whereby when being extended and retracted they move in a sizable engagement with each other to prevent the undesirable biasing of said deadbolts during such movement and also when in their extended and retracted positions relative to a common longitudinal axis, said cam pin carrier being rotatable by said locking member approximately 180°, and said deadbolts each being movable by turning said locking member by a longitudinal distance that is about equal to the diameter of said cam pin carrier.

15. A safety locking device for firearms having an ejection port and a chamber; said device comprises: a housing having a configuration so that it can be received in the ejection port of the firearm for which it is designed; a pair of locking deadbolts slidably received at each end of said housing which are extensible relative thereto and at least one of which is adapted to be received in the chamber of the firearm for which the locking device is designed; a locking device firmly attached to and extending normally from said housing so that it will project out of said ejection port when said housing including said deadbolts are received therein; a cam pin carrier including cam pin members operatively connected to said deadbolts and said locking member in a positive engagement so that when said locking member moves said cam pin carrier in a first direction, said deadbolts are moved outwardly relative to said housing so that at least one of said deadbolts is received in said chamber and is locked therein, and when said locking member moves said cam pin carrier in a second direction, said deadbolts are retracted into said housing, and said one deadbolt is retracted form said chamber so that the device can be removed form the ejection port of the firearm involved, said deadbolts, being in slidable engagement with each other whereby when being extended and extracted they move in slidable engagement with each other to prevent the undesirable biasing of said deadbolts during said movement and also when in their extended and retracted positions relative to a common longitudinal axis, said cam pin carrier having on opposite sides thereof said am pin members which internally engage openings in corresponding said deadbolts, said deadbolts comprising a first deadbolt and a second deadbolt, the first said deadbolt being telescopically received in said second deadbolt, each said deadbolt comprising an aperture for receiving a corresponding said cam pin member and further comprising a cam alignment groove for receiving said cam pin member of the other said deadbolt, said cam alignment grooves also serving to limit rotation of said cam pin carrier.

16. A safety locking device for firearms having an ejection port and a chamber; said device comprises: a housing having a configuration so that it can be received in the ejection port of the firearm for which it is designed; a pair of locking deadbolts slidably received at each end of said housing which are extensible relative thereto and at least one of which is adapted to be received in the chamber of the firearm for which the locking device is designed; a locking device firmly attached to and extending normally from said housing so that it will project out of said ejection port when said housing including said deadbolts are received therein; a cam pin carrier including cam pin members operatively connected to said deadbolts and said locking member in a positive engagement so that when said locking member moves said cam pin carrier in a first direction, said deadbolts are moved outwardly relative to said housing so that at least one of said deadbolts is received in said chamber and is locked therein, and when said locking member moves said cam pin carrier in a second reaction, said deadbolts are retracted into said housing, and said one deadbolt is retracted form said chamber so that the device can be removed form the ejection port of the firearm involved, said deadbolts being in slidable engagement with each other, whereby when being extended and retracted they move in a slidable engagement with each other to prevent the undesirable biasing of said deadbolts during said movement and also when in their extended and retracted positions relative to a common longitudinal axis, said cam pin carrier having on opposite sides thereof said cam pin members which internally engage openings in corresponding said deadbolts, said deadbolts each comprising an inwardly extending portion, said portions adapted to slide against each other and said deadbolts also each including a cam guidance channel that receives a corresponding said cam pin member.

17. A safety device for firearms having an ejection port and a chamber; said comprises:

a housing having a configurations o that it can be receive din the ejection port of a firearm for which it is intended;

a pair of locking deadbolts slidably received at each end of said housing which are extensible relative thereto and at least one of which is adapted to be received in the chamber of the firearm for which the locking device is designed;

a locking member firmly attached to and extending normally form said housing so that it will project out of said ejection port when said housing including said deadbolts are received therein;

a cam pin carrier including cam pin members operatively connected to said deadbolts and said locking member in a positive engagement so that when said locking member moves said cam pin carrier in a first direction, said deadbolts are moved outwardly relative to said housing so that at least one said deadbolts i received in said chamber and is locked therein, and when said locking member moves said cam pin carrier in a second direction, said deadbolts are retracted into said housing, sand said one deadbolts is retracted from said chamber so that the device can be removed from the ejection port of the firearm involved, said deadbolts being in slidable engagement with each other, whereby when being extended and retracted they move in a slidable engagement with each other to prevent the undesirable biasing of said deadbolts during such movement and also when in their extended and retracted positions relative to a common longitudinal axis, a plurality of discreet different extended positions to which said deadbolts can be extended, and means for retaining said deadbolts selectively in each of said extended positions.

18. A safety device for firearms having an ejection port and a chamber; said device comprises:

a housing having a configuration so that it can be received in the ejection port of the firearm for which it is designed;

a pair of locking deadbolts slidably received at each end of said housing which are extensible relative thereto and at least one of which is adapted to be received in the chamber of the firearm for which the locking device is designed;

a locking member firmly attached to and extending normally from said housing so that it will project out of said ejection port when said housing including said deadbolts are received therein;

a cam pin carrier including cam pin members operatively connected to said deadbolts and said locking member in a positive engagement so that when said locking member moves said cam pin carrier in a first direction, said deadbolts are moved outwardly relative to said housing so that at least one of said deadbolts is received in said chamber and is locked therein, and when said locking member moves said cam pin carrier in a second direction, said deadbolts are retracted into said housing, and said one deadbolt is retracted from said chamber so that the device can be removed from the ejection port of the firearm involved, said deadbolts being in slidable engagement with each other, whereby when being extended and retracted they move in a slidable engagement with each other to prevent the undesirable biasing of said deadbolts during such movement and also when in their extended and retracted positions relative to a common longitudinal axis, said deadbolts being telescopically connected and being rotated in opposite directions by said cam pin carrier when they are being extended.

19. A safety device of forearms having an ejection port and a chamber; said device comprises:

a housing having a configuration so that it can be received in the ejection port of the firearm for which it is designed;

a pair of locking deadbolts slidably received at each end of said housing which are extensible relative thereto and at least one of which is adapted to be received in the chamber of the firearm for which the locking device is designed;

a locking member firmly attached to and extending normally from said housing so that it will project out of said ejection port when said hosing including said deadbolts are received therein;

a cam pin carrier including cam pin members operatively connected to said deadbolts and said locking member in a positive engagement so that when said locking member moves said cam pin carrier in a first direction, said deadbolts are moved outwardly relative to said housing so that at least one of said deadbolts is received in said chamber and is locked therein, and when said locking member moves said cam pin carrier in a second direction, said deadbolts re retracted into said housing, sand said one deadbolt is tracked from said chamber so that the device can be removed from the ejection port of the firearm involved, said deadbolts being in slidable engagement with each other, whereby when being extended and retracted they move in a slidable engagement with each other to prevent the undesirable biasing of said deadbolts during such movement and also when in their extended and retracted positions relative to a common longitudinal axis, means for removing said deadbolts, and at least one further deadbolt of a different size than a said deadbolt which has been removed from said device, said one further deadbolt being selectively installed in place of said deadbolt which was removed.

20. A safety locking device in accordance with claim 1, wherein said housing includes means to prevent relative rotation by said deadbolts relative to said housing.

21. A safety device for revolvers having a recoil plate, cylinder, and forcing cone; said device comprises:

a housing having a configuration so that it can be inserted into the space between the recoil plate and forcing cone of the revolver for which it is designed with the revolver's cylinder removed therefrom;

a pair of locking deadbolts slidably received at each end of said housing which are extensible relative thereto nd at least one of which is adapted to be received in the forcing cone of the revolver for which the locking device is designed;

a locking member firmly attached to and extending normally from said housing so that it will project out of said space when said housing including said deadbolts are receive therein; and a cam pin carrier including cam pin members operatively connected to said deadbolts and said locking member in a positive engagement so that when said locking member moves said cam pin carrier in a first direction, said deadbolts are moved outwardly relative to said housing so that one of said deadbolts is received in said forcing cone and is locked therein, and when said locking members moves said cam pin carrier in a second direction, said deadbolts are retracted into said housing, sand said one deadbolt is retracted from said forcing cone so that the device can be removed from said space of the revolver involved, said deadbolts being in slidable engagement with each other, whereby when being extended and retracted they move in a slidable engagement with each other to prevent the undesirable biasing of said deadbolts during such movement and also when in their extended and retracted positions they retain the same common longitudinal axis.

22. A safety device for revolvers having a recoil plate, cylinder, and forcing cone; said device comprises:

a housing having a configuration so it can be received in the space between the forcing cone and recoil plate of the revolver for which it is deigned when its cylinder is removed from said space;

a pair of locking deadbolts slidably received in each end of said housing which are extensible relative thereto, sand at least one of which is adapted to be received in the forcing cone of the revolver for which the locking device is designed;

a locking member firmly attached to ad extending normally from said housing os that it will project out of said space when said housing, including said deadbolts, is received therein, said locking member comprising a plurality of resiliently biased disc tumblers; and a key member included in said locking member, a plurality of recesses in said housing cooperating with said tumblers to release said key member from said locking member so that it can be removed therefrom when said locking member is received in said spaced, said tumblers when not in said plurality of recesses functioning to retain said key member in said locking member at all times except when said locking deadbolts re in extended positions relative to said housing.

* * * * *